US007114708B2

(12) United States Patent
Douyama et al.

(10) Patent No.: US 7,114,708 B2
(45) Date of Patent: Oct. 3, 2006

(54) ROTARY THROTTLE VALVE CARBURETOR

(75) Inventors: Yoshiaki Douyama, Shiroishi (JP); Shinichi Ohgane, Miyagi-Pref. (JP); Jun Takano, Miyagi-Pref. (JP); Teruhiko Tobinai, Sendai (JP)

(73) Assignee: Walbro Japan, Inc., Tokyo (JP)

( * ) Notice: Subject to any disclaimer, the term of this patent is extended or adjusted under 35 U.S.C. 154(b) by 180 days.

(21) Appl. No.: 10/860,612

(22) Filed: Jun. 3, 2004

(65) Prior Publication Data

US 2004/0251565 A1 Dec. 16, 2004

(30) Foreign Application Priority Data

Jun. 12, 2003 (JP) ..... 2003-167408

(51) Int. Cl.
*F02M 9/08* (2006.01)

(52) U.S. Cl. ..... 261/44.6; 261/44.8; 261/60; 261/DIG. 39

(58) Field of Classification Search ..... 261/44.3–44.8, 261/60, 66, DIG. 38, DIG. 39
See application file for complete search history.

(56) References Cited

U.S. PATENT DOCUMENTS 1,209,901 A * 12/1916 Stevens ..... 261/49
1,339,095 A * 5/1920 Bradshaw ..... 261/66
2,562,826 A * 7/1951 Sharp ..... 261/44.8
3,147,320 A * 9/1964 Tubb ..... 261/51
4,481,152 A 11/1984 Kobayashi et al. ..... 261/35
4,481,153 A 11/1984 Kobayashi et al. ..... 261/44.2
5,300,259 A * 4/1994 Tashiro ..... 261/44.3
5,599,484 A 2/1997 Tobinai ..... 261/44.2
6,394,425 B1 * 5/2002 Nagata ..... 261/44.8
6,431,527 B1 * 8/2002 Suzuki et al. ..... 261/44.3
6,585,235 B1 * 7/2003 Pattullo ..... 261/44.8
6,672,570 B1 * 1/2004 Takano et al. ..... 261/39.2
2003/0111743 A1 * 6/2003 Ohgane et al. ..... 261/44.8

FOREIGN PATENT DOCUMENTS

JP 1-318754 * 12/1989 ..... 261/44.6

* cited by examiner

*Primary Examiner*—Richard L. Chiesa
(74) *Attorney, Agent, or Firm*—Reising, Ethington, Barnes, Kisselle, P.C.

(57) ABSTRACT

A rotary throttle valve carburetor includes a body having a fuel and air mixing passage and a throttle valve movable between idle and wide open positions. A valve bore is increasingly aligned with the fuel and air mixing passage as the throttle valve is moved from idle toward its wide open position. A fuel metering needle is responsive to movement of the throttle valve so that the needle moves relative to the body in response to movement of the throttle valve. A fuel nozzle extends into the valve bore, is associated with the fuel metering needle, and has a fuel ejection passage with an effective flow area controlled by movement of the fuel metering needle relative to the fuel nozzle and includes a portion with a cross-sectional area that gradually increases in the direction of fuel metering needle movement corresponding to throttle valve movement toward its wide open position.

16 Claims, 5 Drawing Sheets

ROTARY THROTTLE VALVE CARBURETOR

REFERENCE TO RELATED APPLICATION

Applicants claim priority of Japanese Application Ser. No. 2003-167408, filed on Jun. 12, 2003.

FIELD OF THE INVENTION

The present invention relates generally to carburetors and more particularly to a rotary throttle valve carburetor.

BACKGROUND OF THE INVENTION

A rotary throttle valve carburetor comprises a carburetor main body having a fuel and air mixing passage formed therein, a cylindrical valve chamber formed in the main body perpendicular to the fuel and air mixing passage and, a rotary throttle valve received in the valve chamber for rotary and axial movement. The throttle valve includes a shaft with a through hole or passage that is increasingly aligned with the fuel and air mixing passage as the throttle valve is moved toward its open position. In such a carburetor, because the negative pressure in the fuel and air mixing passage is relatively high at idle and low speed positions of the throttle valve, fuel supply at idle and low speed engine operation tends to be excessive and difficult to control.

SUMMARY OF THE INVENTION

A rotary throttle valve carburetor includes a body having a fuel and air mixing passage and a throttle valve carried by the body for movement between idle and wide open positions. The throttle valve has a valve bore that is increasingly aligned with the fuel and air mixing passage as the throttle valve is moved from its idle position toward its wide open position. A fuel metering needle extends into the valve bore, and is responsive to movement of the throttle valve so that the needle moves relative to the body in response to movement of the throttle valve. And a fuel nozzle extends into the valve bore, is communicated with a supply of fuel and is operably associated with the fuel metering needle. The fuel nozzle has a fuel ejection passage with an effective flow area controlled by movement of the fuel metering needle relative to the fuel nozzle and includes a portion with a cross-sectional area that gradually increases in the direction of fuel metering needle movement corresponding to movement of the throttle valve toward its wide open position. This controls, at least in part, fuel flow from the fuel supply, through the fuel nozzle and into the fuel and air mixing passage.

According to another aspect of the invention, a fuel nozzle for a carburetor includes a body having a base adapted to be carried by the carburetor and an open end opposite the base, a central passage open to the open end, a groove open to the central passage and the open end, and a fuel orifice formed through a portion of the body and communicating the central passage with the exterior of the body. Fuel is provided through both the groove and the fuel orifice to facilitate control of the flow rate of fuel delivered from the carburetor over a wide range of engine operating conditions.

Some objects, features, advantages and aspects that may be achieved by at least some embodiments of the present invention include providing a carburetor that facilitates control of the flow rate at which fuel is delivered from the carburetor during operation at low engine fuel demand, provides sufficient fuel flow rates under high engine fuel demand operation, provides a gradual change in the effective flow area of a fuel nozzle over a predetermined range of engine operation with a relatively low fuel demand, improves engine performance, reduces hydrocarbon emissions from the engine, is of relatively simple design and economical manufacture and assembly, is rugged, durable and has in service a long useful life.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
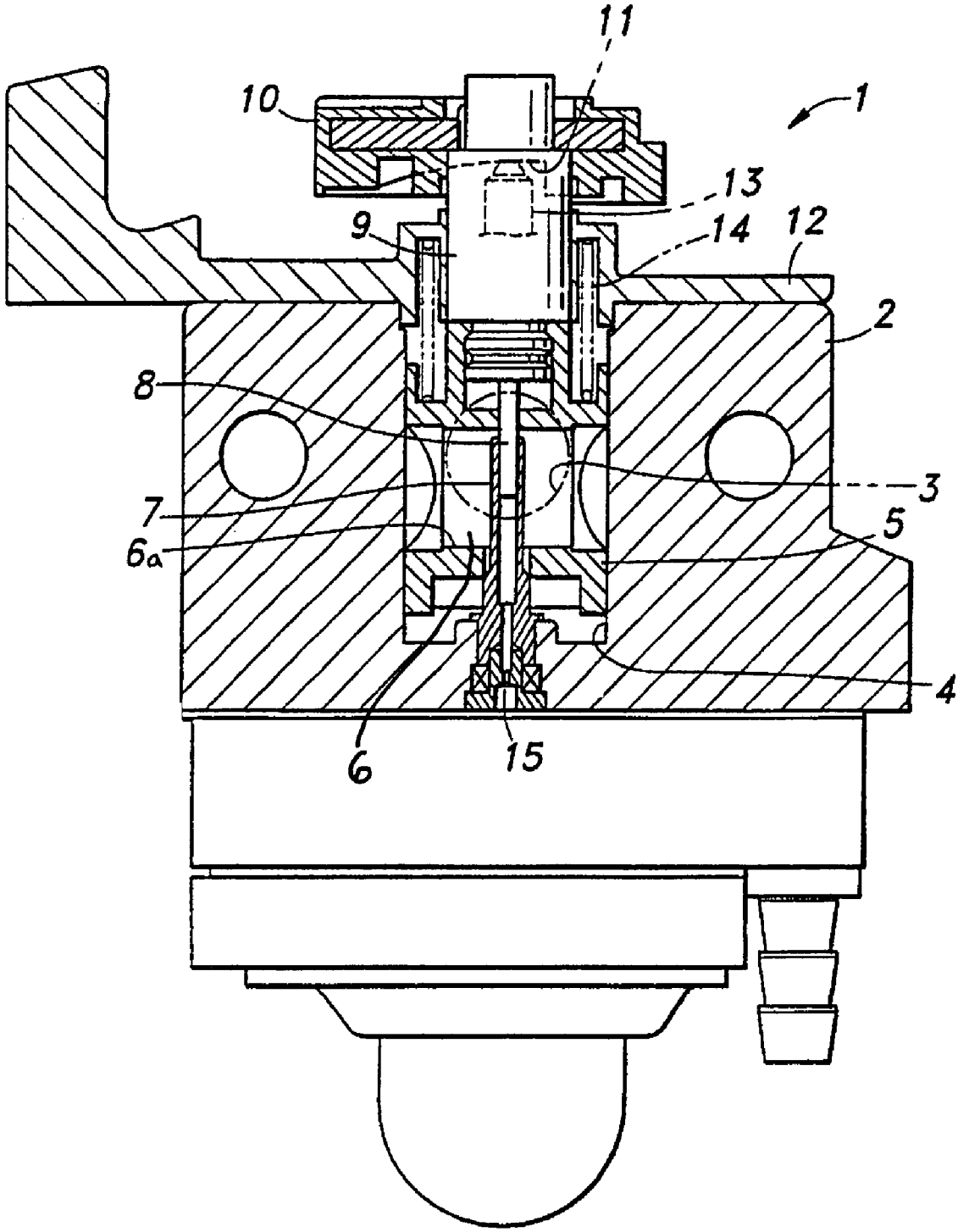
FIG. 1 is a sectional view of a carburetor according to one presently preferred embodiment of the present invention.
Figure 2:
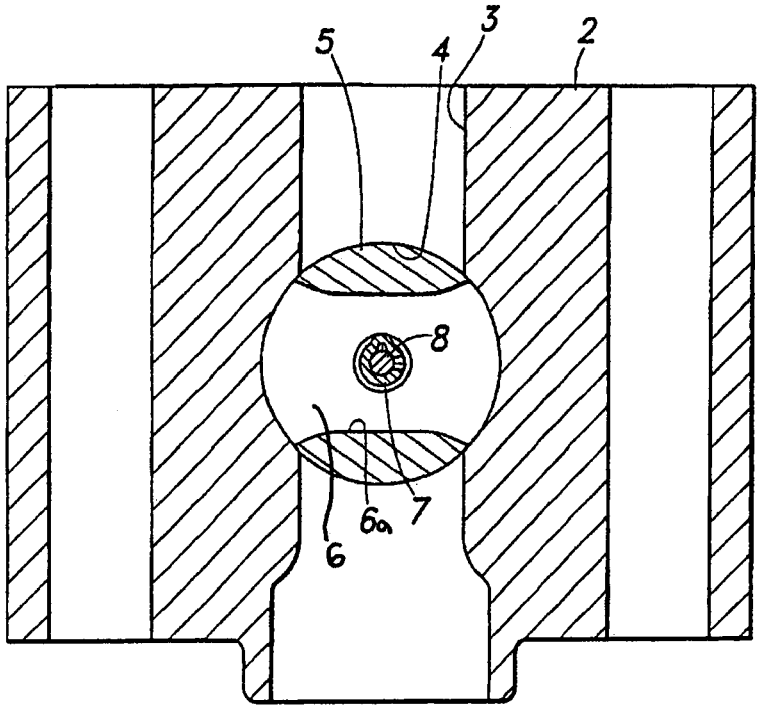
FIG. 2 is a sectional view taken along the center line of a fuel and air mixing passage of the carburetor and illustrating a throttle valve in its idle position.
Figure 3:
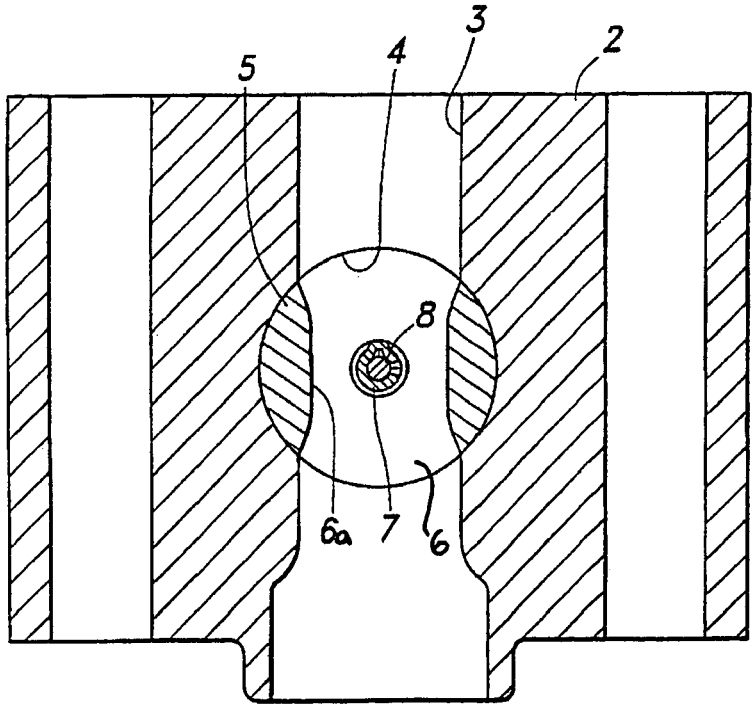
FIG. 3 is a sectional view taken along the center line of the fuel and air mixing passage illustrating the throttle valve in its wide open position.
Figure 4:
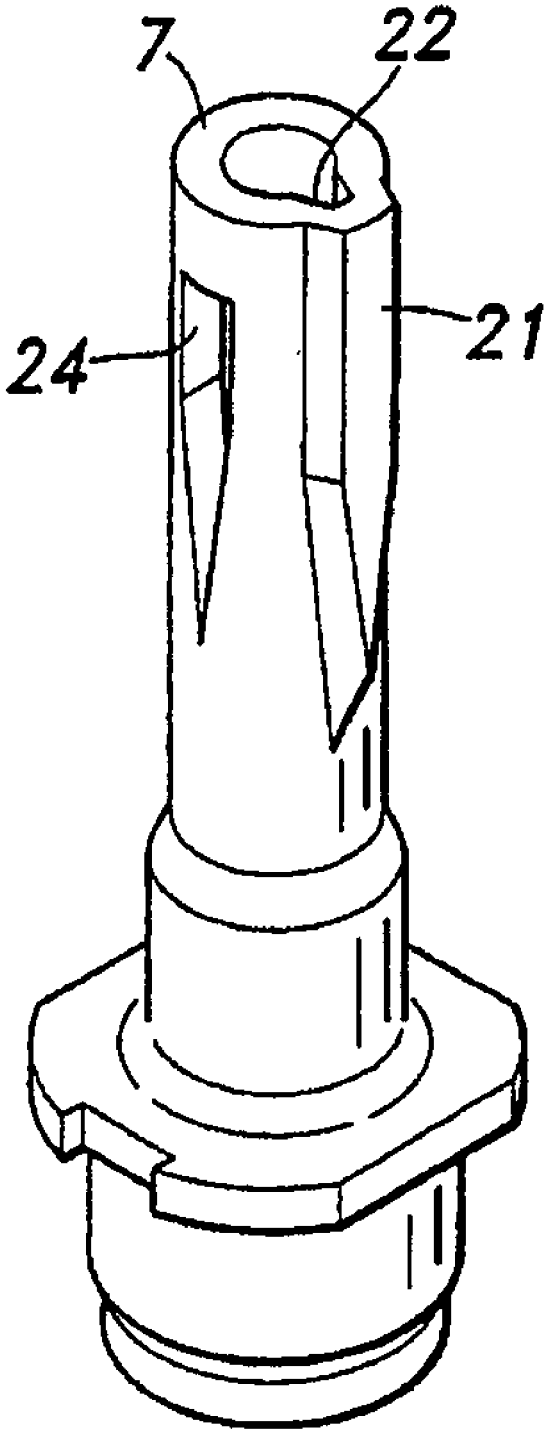
FIG. 4 is a perspective view of a fuel nozzle of the carburetor.
Figure 5:
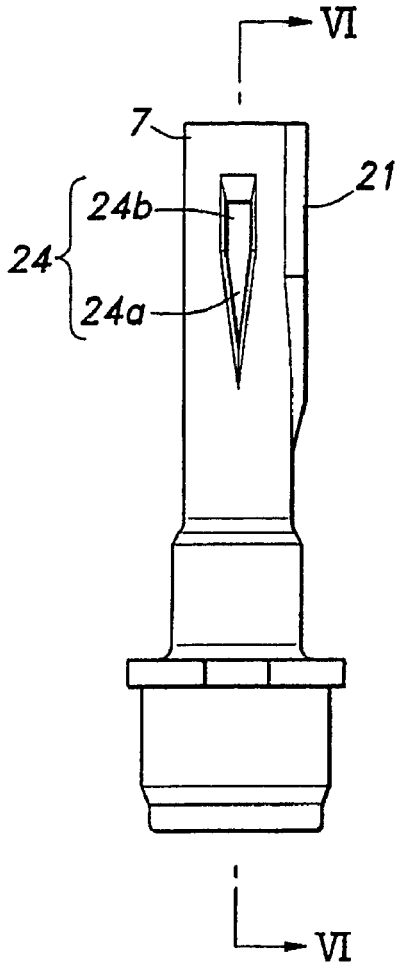
FIG. 5 is a side view of the fuel nozzle.
Figure 6:
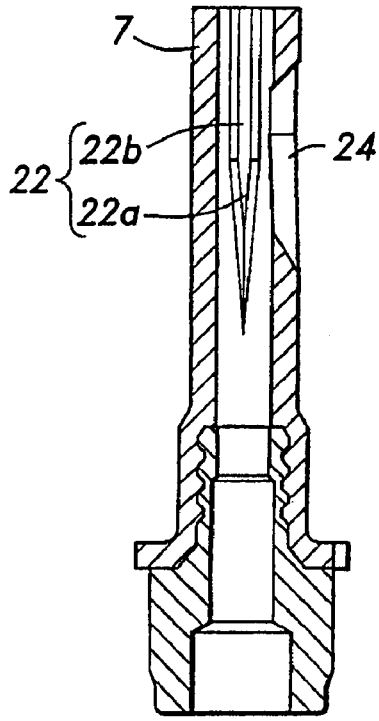
FIG. 6 is a side view taken along line 6—6 of FIG. 5.
Figure 8:
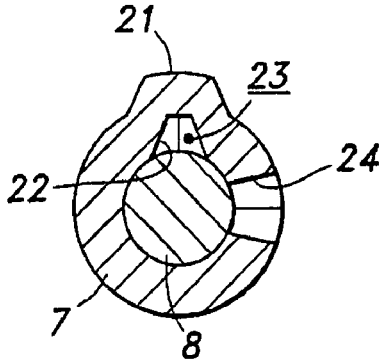
FIG. 8 is a sectional view taken along line 8—8 of FIG. 7.
Figure 7:
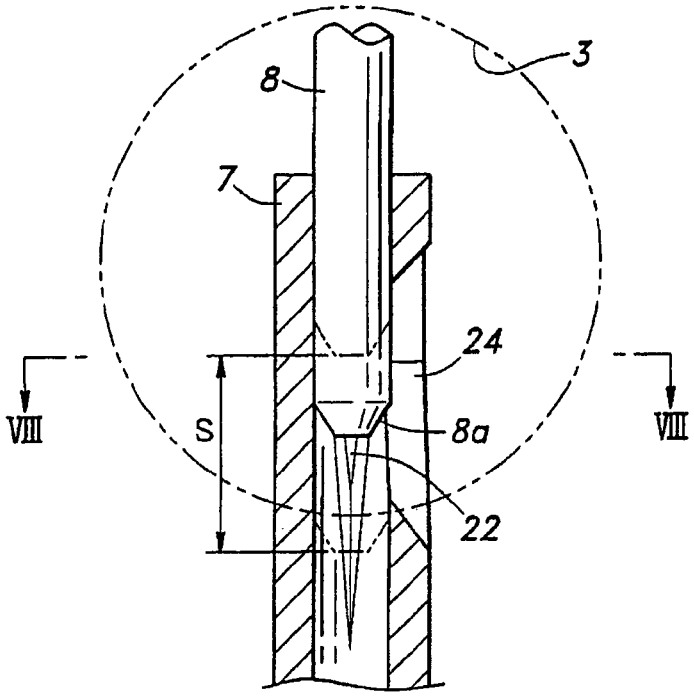
FIG. 7 is a fragmentary sectional view showing a needle received in the fuel nozzle.

Referring in more detail to the drawings, FIG. 1 shows a rotary throttle valve carburetor according to one presently preferred embodiment of the invention. The carburetor 1 includes a carburetor main body 2, a fuel and air mixing passage 3 extending through the main body 2, a cylindrical valve chamber 4 formed in the main body 2 perpendicular to the fuel and air mixing passage 3, and a cylindrical rotary throttle valve 5 rotatably and slidably received in the valve chamber 4. The rotary throttle valve 5 includes a valve bore 6 that may have a venturi or reduced diameter neck portion 6*a*. The throttle valve 5 at least substantially closes the fuel and air mixing passage 3 when the throttle valve is in its idle position, (see FIG. 2), and preferably fully opens the fuel and air mixing passage 3 when the throttle valve 5 is in its wide or fully open position (see FIG. 3). The carburetor 1 further has a tubular fuel nozzle 7 projecting into the valve chamber 4 and the valve bore 6 in the throttle valve 5, and a fuel metering needle 8 depending coaxially from the throttle valve 5 into the fuel nozzle 7.

The upper end of the throttle valve 5 is connected to a valve shaft 9. A throttle lever 10 is attached to the upper end of the valve shaft 9. The lower surface of the throttle lever 10 is formed with a cam surface 11, and a cam follower 13 projecting from an upper cover 12, which is carried by the upper surface of the main body 2, engages this cam surface 11 to axially displace the throttle valve 5 as it is rotated.

A torsion coil spring 14 is interposed between the lower surface of the upper cover 12 and the upper end of the rotary throttle valve 5, and is wrapped around the valve shaft 9 to yieldably bias the throttle valve 5 angularly and axially toward its idle position. The force of this spring 14 biases the cam surface 11 against the cam follower 13 so that the rotation of the throttle lever 10 causes the rotary throttle valve 5 to move vertically as controlled by the contour of the cam surface 11.

Referring to FIGS. 4 to 8, the fuel nozzle 7 includes a body with a base adapted to be carried by the carburetor body 1, an open upper end and a central passage in which the needle 8 is slidably received. The central passage preferably extends axially to the open end of the fuel nozzle body and communicates with a fuel supply through the fuel jet 15 to permit fuel flow through the fuel nozzle and into the fuel and air mixing passage for delivery to an engine. The fuel nozzle has an axially and radially outwardly extending section 21. The section 21 defines a groove 22 including a lower half 22*a* with a width that progressively increases from the lower end to the upper end thereof, and an upper half 22*b* with a width that preferably is substantially constant. In cooperation with the outer surface of the needle 8 (see FIG. 8), this groove 22 defines a fuel ejection passage 23. As shown, the lower half of the fuel ejection passage 23 may be generally triangular with an apex at its axially lower end. The fuel ejection passage 23 is preferably open to the open end of the fuel nozzle body and is communicated with the valve bore 6 and the fuel and air mixing passage 3. Accordingly fuel flows from the central passage, to the fuel ejection passage 23, and from there, the fuel flows from the upper end of the fuel nozzle body (via the open end of the fuel ejection passage 23) to the fuel and air mixing passage 3. The needle 8 is preferably sized to at least substantially seal the central passage and prevent significant fuel flow through the central passage around the needle (other than into the groove 22 and ejection passage 23).

The fuel nozzle 7 also includes an axially elongated orifice 24 formed through a sidewall of the fuel nozzle body communicating the exterior of the fuel nozzle body with the central passage. The orifice 24 includes a lower half 24*a* that is preferably generally triangular and has a width that preferably progressively increases from the lower end to the upper end thereof and an upper half 24*b* with a width that preferably is substantially constant. The lower end of the orifice 24 is preferably located higher than the lower end of the groove 22 so that the orifice 24 opens only when the needle 8 has been lifted a predetermined amount. The orifice 24 may have any desired size and shape, including, by way of examples without limitation, a constant width over its entire length or a gradually varying width over its entire length.

When the throttle valve 5 is rotated from its idle position toward its wide open position, it moves axially under influence of the cam surface 11 and cam follower 13, and the needle 8 which is carried by the throttle valve 5 moves axially out of the fuel nozzle 7 by a prescribed stroke. As a result, the free end of the needle 8 moves over the range indicated by letter-S in FIG. 7 and progressively uncovers or opens the fuel ejection passage 23 and the fuel orifice 24. In other words, the frusto-conical free end of the needle 8 moves along the length of the groove 22 and orifice 24 formed in the fuel nozzle 7 so that the effective opening areas of the orifice 24 and fuel ejection passage 23 are varied and the rate at which fuel is supplied from the fuel jet 15 and the fuel nozzle 7 into the fuel and air mixing passage 3 is controlled as desired. Also, the change in the angular position of the throttle valve 5 changes the extent to which the throttle valve bore 6 is open to or aligned with the fuel and air mixing passage 3, and the air flow in the fuel and air mixing passage 3 is controlled as desired.

Accordingly, when the throttle valve 5 is opened fuel is mixed with air flowing through the fuel and air mixing passage 3 and is delivered to a combustion chamber of an engine in a fuel and air mixture. The basic fuel supply for idle engine operation can be adjusted by changing the axial position of the needle 8 with respect to the valve shaft 9, and hence, with respect to the fuel nozzle 7.

In the carburetor 1 described above, as indicated by the solid line 30 in FIG. 9, when the throttle valve 5 is in or near its idle position so that the needle 8 has not been significantly axially moved relative to the fuel nozzle 7, the frusto-conical end 8*a* of the needle 8 is disposed adjacent to the lower half 22*a* of the fuel ejection passage 23 which has an axially varying width, so the change in the effective cross-sectional area of the fuel ejection passage 23 with the vertical movement of the needle 8 is very gradual. Therefore, an idling fuel flow rate is achieved only when the needle lift has reached point B (FIG. 9) according to this presently preferred embodiment, whereas prior art carburetors provide such a fuel flow rate with less needle lift, such as at point A as shown by the dashed line 32 in FIG. 9. In other words, the rate at which fuel flow increases for a given lift of the needle, over a given range of throttle valve 5 movement, is reduced. This permits increased control over idle and low engine speed fuel delivery even with a relatively strong vacuum signal in the carburetor mixing passage 3.

Figure 9:
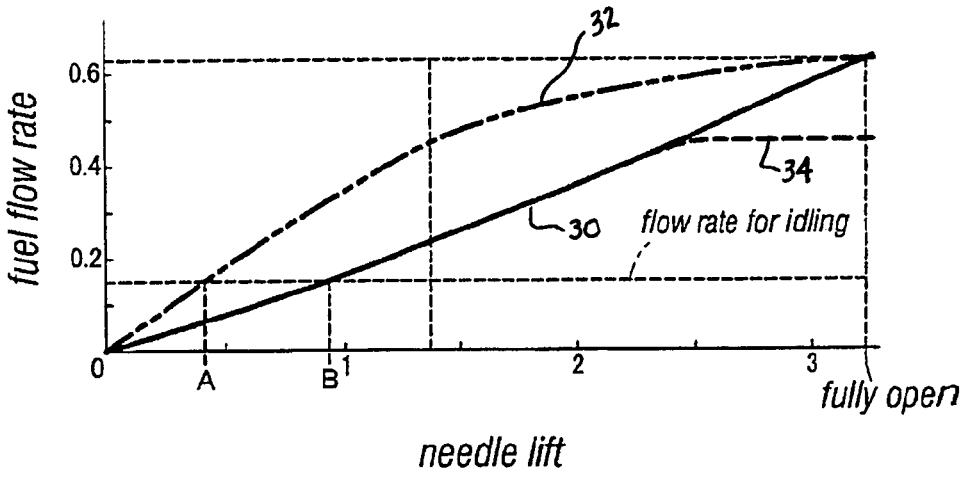
FIG. 9 is a graph showing change in the fuel flow rate as a function of needle lift.

The fuel flow rate provided solely by the fuel ejection passage 23 formed by the groove 22 is preferably insufficient for high-speed or high load engine operation and reaches a maximum flow rate at and above a certain lift of the throttle valve as indicated by the broken line 34 in FIG. 9. Therefore, according to the present invention, the orifice 24 also communicates with the venturi passage 6 to provide fuel therethrough and into the fuel and air mixing passage. As a result, even when the total lift or stroke of the needle 8 is limited, by reducing the rate of change of the cross-sectional area of the effective total fuel outlet in the low lift range of the needle 8 and by adequately increasing the opening area of the effective total fuel outlet (e.g. including both the fuel ejection passage 23 and orifice 24) in the high lift range of the needle 8, it is possible to achieve both the ease of adjustment of the fuel flow rate in a low throttle opening range and an adequate fuel flow rate in a high throttle opening range as indicated by the solid line 30 in FIG. 9.

Accordingly, abrupt fuel flow rate changes in relation to the needle lift in a lower opening angle range of the throttle valve 5 can be mitigated by forming a fuel ejection passage 23 having a portion that gradually increases in cross-sectional area in the upward direction on a side of the outer wall of the fuel nozzle 7. Thereby, the fuel flow control is improved when the throttle valve is in or near its idle position. By additionally providing an orifice 24 communicating with the venturi passage when the opening angle of the throttle valve is greater than a certain value, an adequate fuel supply can be ensured when the rotary throttle valve is at or sufficiently near its wide open position.

The invention claimed is:

1. A rotary throttle valve carburetor, comprising:

a body having a fuel and air mixing passage;

a throttle valve carried by the body for movement between idle and wide open positions, having a valve bore that is increasingly aligned with the fuel and air mixing passage as the throttle valve is moved from its idle position toward its wide open position;

a fuel metering needle depending into the valve bore, and responsive to movement of the throttle valve for movement relative to the body in response to movement of the throttle valve; and a fuel nozzle projecting into the valve bore, communicated with a supply of fuel and operably associated with the fuel metering needle, the fuel nozzle having a fuel ejection passage with an effective flow area controlled by movement of the fuel metering needle relative to the fuel nozzle and including a portion with a cross-sectional area that gradually increases in the direction of fuel metering needle movement corresponding to movement of the throttle valve toward its wide open position to at least in part control fuel flow from the fuel supply, through the fuel nozzle and into the fuel and air mixing passage.

2. The carburetor of claim 1 wherein the portion of the fuel ejection passage with a gradually increasing cross-sectional area is substantially covered by the fuel metering needle when the throttle valve is in its idle position, and is increasingly uncovered as the throttle valve is moved away from its idle position to control in part fuel flow through the fuel nozzle when the throttle valve is in its idle position and as the throttle valve is moved a predetermined amount from its idle position.

3. The carburetor of claim 1 wherein the fuel nozzle also includes a fuel orifice spaced from the fuel ejection passage and having a flow area that is controlled by movement of the fuel metering needle, the fuel orifice is located on the fuel nozzle so that the fuel metering needle at least substantially prevents fuel flow through the fuel orifice until the throttle valve is moved a predetermined amount away from its idle position.

4. The carburetor of claim 3 wherein the fuel orifice is positioned relative to the fuel ejection passage so that when the throttle valve is between its idle position and a predetermined position away from its idle position, fuel flow occurs at least substantially only through the fuel ejection passage and when the throttle valve is between said predetermined position and its wide open position, fuel flow occurs through both the fuel ejection passage and the fuel orifice.

5. The carburetor of claim 1 wherein the throttle valve is moved along an axis when it is moved toward and away from its idle position, the fuel metering needle is carried by the throttle valve, and the fuel ejection passage is axially elongate so that the effective flow area of the fuel ejection passage changes as the fuel metering needle is moved axially over a predetermined range of throttle valve movement.

6. The carburetor of claim 5 wherein the fuel ejection passage has a minimum width at its axial lower end.

7. The carburetor of claim 5 wherein the fuel nozzle also includes a fuel orifice spaced from the fuel ejection passage and having a flow area that is controlled by movement of the fuel metering needle which at least substantially prevents fuel flow through the fuel orifice until the throttle valve is moved a predetermined amount away from its idle position.

8. The carburetor of claim 7 wherein the fuel orifice is formed through a wall of the fuel nozzle.

9. The carburetor of claim 8 wherein the fuel orifice has a first portion with a width that varies along its axial length and a second portion with a width that is substantially constant over its axial length.

10. The carburetor of claim 1 wherein the fuel nozzle has an open upper end in which an end of the fuel metering needle is slidably received, and the fuel ejection passage is defined be a groove in the fuel nozzle that communicates with the open upper end of the fuel nozzle even when the fuel metering needle is received in the fuel nozzle so that fuel may flow in the groove between the fuel nozzle and the fuel metering needle and out the open upper end of the fuel nozzle for delivery into the fuel and air mixing passage.

11. The carburetor of claim 10 wherein the fuel metering needle has an axis and is moved axially as the throttle moves, and the fuel ejection passage has a width that gradually increases in the direction of movement of the fuel metering needle that corresponds to movement of the throttle valve away from its idle position.

12. The carburetor of claim 11 wherein the fuel metering needle is sized for close receipt in the fuel nozzle to at least substantially prevent fuel leakage between the fuel metering needle and the fuel nozzle in areas other than the fuel ejection passage.

13. The carburetor of claim 12 wherein the groove has a width that varies over at least a portion of its length.

14. The carburetor of claim 12 wherein the portion of the fuel ejection passage comprises a fuel orifice having a width that varies over the length of the fuel orifice.

15. The carburetor of claim 12 wherein the groove has a portion disposed closer to the base than does the fuel orifice.

16. The carburetor of claim 12 wherein the portion of the fuel ejection passage comprises a fuel orifice circumferentially spaced from the groove.

* * * * *